US007508918B2

(12) United States Patent
Liu et al.

(10) Patent No.: US 7,508,918 B2
(45) Date of Patent: Mar. 24, 2009

(54) COLLIMATOR FOR ADJUSTING X-RAY BEAM

(75) Inventors: Yinong Liu, Beijing (CN); Zhiqiang Chen, Beijing (CN); Yuanjing Li, Beijing (CN); Wanlong Wu, Beijing (CN); Yulan Li, Beijing (CN); Xilei Luo, Beijing (CN); Li Zhang, Beijing (CN); Ziran Zhao, Beijing (CN); Bin Sang, Beijing (CN); Hailin Wang, Beijing (CN)

(73) Assignees: Nuctech Company Limited, Beijing (CN); Tsinghua University, Beijing (CN)

( * ) Notice: Subject to any disclaimer, the term of this patent is extended or adjusted under 35 U.S.C. 154(b) by 166 days.

(21) Appl. No.: 11/525,692

(22) Filed: Sep. 22, 2006

(65) Prior Publication Data

US 2007/0064877 A1 Mar. 22, 2007

(30) Foreign Application Priority Data

Sep. 22, 2005 (CN) ..... 2005 1 0086456

(51) Int. Cl.
*G21K 1/04* (2006.01)

(52) U.S. Cl. ..... 378/152; 378/147; 378/150

(58) Field of Classification Search ..... 378/147, 378/150, 151, 152, 153, 160
See application file for complete search history.

(56) References Cited

U.S. PATENT DOCUMENTS 4,532,711 A * 8/1985 Shirai ..... 33/556
4,936,655 A * 6/1990 Leib et al. ..... 359/896
5,237,599 A * 8/1993 Gunji et al. ..... 378/148
5,396,534 A * 3/1995 Thomas ..... 378/160
5,574,766 A * 11/1996 Panasik ..... 378/147
5,771,270 A * 6/1998 Archer ..... 378/65
6,193,226 B1 * 2/2001 Davies ..... 269/71
6,471,419 B1 * 10/2002 Hall et al. ..... 385/91
6,498,892 B1 * 12/2002 Harman ..... 385/137
6,543,740 B2 * 4/2003 Gaunt et al. ..... 248/476
7,397,900 B2 * 7/2008 Papaioannou et al. ..... 378/147

* cited by examiner

*Primary Examiner*—Allen C. Ho
(74) *Attorney, Agent, or Firm*—Kinney & Lange, P.A.

(57) ABSTRACT

A collimator for adjusting an X-ray beam includes: an up-and-down adjustment mechanism; a left-and-right adjustment mechanism, a supporting member; and an adjusting plate connected with the supporting member. The up-and-down adjustment mechanism comprises first rotating nuts, up-and-down moving leading screws threadedly connected with the first rotating nuts, and upper and lower sliding stops located in the supporting member. Each of the leading screws is connected with the upper and lower sliding stops to drive the upper and lower sliding stops, respectively, to vertically move. The left-and-right adjustment mechanism comprises second rotating nuts, horizontally moving leading screws connected with second rotating nuts, and left and right sliding stops located in the supporting member. Each of the horizontally moving leading screws are connected with the left and right sliding stops to drive the left and right sliding stops, respectively, to horizontally move.

16 Claims, 2 Drawing Sheets

COLLIMATOR FOR ADJUSTING X-RAY BEAM

FIELD OF THE INVENTION

The present invention relates to the radiation detecting technical field, and more particularly, to a collimator for adjusting X-ray beam.

DESCRIPTION OF THE RELATED ART

In some radiation detecting systems, such as CT imaging systems, X-ray tubes are used to generate X-ray. The X-ray is usually emitted in a conical shape from a focal spot. Since application modes of X-ray are diversified, it is required to employ a collimator to define profiles of X-ray. In the conventional techniques, a linear collimator, a rectangular collimator, or combination thereof is employed to define profiles of X-ray.

The conventional collimator has a large volume and a complicated structure, in which an upper sliding stop and a lower sliding stop can only be opened or closed simultaneously when adjustment is performed, and a left stop and a right stop are usually stationary and are not adjustable. If target points of an X-ray generator are not symmetrically formed between the upper and lower sliding stops, it is required to adjust the position of one of the upper and lower sliding stops and the target points of the X-ray generator, in order to ensure an effective adjustment of the upper and lower sliding stops. Thus, the conventional collimator is disadvantageous in that a larger space is occupied and the adjustment precision is low.

SUMMARY OF THE INVENTION

Accordingly, in order to overcome the defects in the prior art, an object of this invention is to provide a collimator for adjusting X-ray beam. The collimator can symmetrically perform adjustments along an up-and-down direction and along a left-and-right direction around target points of a fixed X-ray generator, so that X-ray beams with different field angles can be obtained.

An object of the invention is to provide an adjustment device for adjusting a collimator that can separately adjust respective sliding stops of the collimator.

In order to achieve the above object of the invention, one aspect of this invention provides a collimator for adjusting X-ray beam, comprising: an up-and-down adjustment mechanism; a left-and-right adjustment mechanism; a supporting member; and an adjusting plate connected with the supporting member, wherein: the up-and-down adjustment mechanism comprises upper and lower first rotating nuts, upper and lower moving leading screws threadedly connected with the upper and lower first rotating nuts, and upper and lower sliding stops located in the supporting member, wherein each of the upper and lower leading screws is connected with the upper and lower sliding stops to drive the upper and lower sliding stops, respectively, to vertically move; and the left-and-right adjustment mechanism comprises left and right second rotating nuts, left and right horizontally moving leading screws connected with the second rotating nuts, and left and right sliding stops located in the supporting member, wherein each of the horizontally moving leading screws is connected with the left and right sliding stops to drive the left and right sliding stops, respectively, to horizontally move. The up-and-down adjustment mechanism further comprises first upper and lower limiting gland covers, and the first upper and lower limiting gland covers are fixed to upper and lower wall surfaces of the supporting member and confine the respective first rotating nuts to rotate within the respective first limiting gland covers.

With the above arrangement, symmetrical adjustments along an up-and-down direction and along a left-and-right direction can be obtained. With rotating nuts, the leading screws move linearly rather than rotate, so that X-ray beams with different field angles can be obtained.

Preferably, the left-and-right adjustment mechanism further comprises left and right second limiting gland covers. The second limiting gland covers are fixed to left and right wall surfaces of the supporting member and confine the respective second rotating nuts to rotate within the respective second limiting gland covers.

Preferably, each of the up-and-down moving leading screws is provided at ends thereof with opening grooves. The opening grooves are connected with the upper and lower sliding stops provided in a longitudinal sliding slot of the supporting member.

Preferably, the horizontally moving leading screw is provided at ends thereof with abutting surfaces. The abutting surfaces are connected with left and right sliding stops provided in the supporting member.

Preferably, the first rotating nut and the second rotating nut are marked with scales and numerals.

Preferably, the up-and-down moving leading screw and the horizontally moving leading screw are marked at ends thereof with scales and numerals corresponding to the first rotating nut and the second rotating nut.

Preferably, a fixed stop is provided behind the upper and lower sliding stops in the supporting member.

Preferably, the upper and lower sliding stops and the left and right sliding stops are made of tungsten alloy or lead alloy.

In order to achieve the above objects of the invention, another aspect of this invention provides an adjustment device for adjusting collimator, comprising:

an up-and-down adjustment mechanism; a left-and-right adjustment mechanism; and a supporting member; wherein:

an up-and-down adjustment mechanism; a left-and-right adjustment mechanism; and a supporting member, wherein: the up-and-down adjustment mechanism comprises upper and lower first rotating nuts, up-and-down moving upper and lower leading screws threadedly connected with the upper and lower first rotating nut, and upper and lower sliding stops located in the supporting member, wherein each of the upper and lower leading screws are connected with the upper and lower sliding stops to drive the upper and lower sliding stops, respectively, to vertically move; and the left-and-right adjustment mechanism comprises left and right second rotating nuts, horizontally moving left and right leading screws connected with the rotating nuts, and left and right sliding stops located in the supporting member, wherein each of the horizontally moving leading screws are connected with the left and right sliding stops to drive the left and right sliding stops, respectively, to horizontally move. The up-and-down adjustment mechanism further comprises first upper and lower limiting gland covers, and the first upper and lower limiting gland covers are fixed to upper and lower wall surfaces of the supporting member and confine the respective first rotating nuts to rotate within the first limiting gland covers.

With the above technical schemes, the following benefits are achieved:

1) The value of field angle of ray beam can be effectively controlled;

2) The width of ray beam can be optionally adjusted;

3) Each adjustment unit on the collimator can be separately adjusted, so that the collimator can be applied to various radiation imaging systems.

DETAILED DESCRIPTION OF THE PREFERRED EMBODIMENT

A preferred embodiment of the present invention will be described herein below with reference to the accompanying drawings. It is to be understood that the following preferred embodiment is only illustrative and will not intend to limit the protection scope of the present invention.

Figure 1:
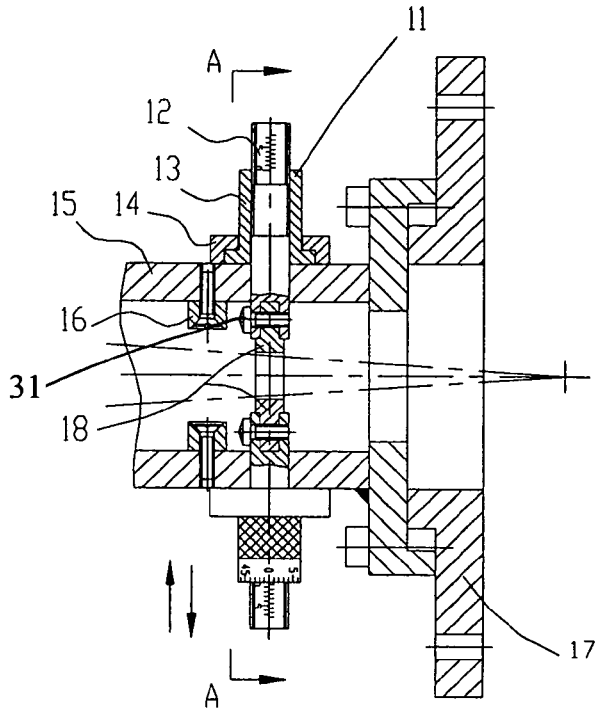
FIG. 1 shows a structural schematic view of this invention.
Figure 2:
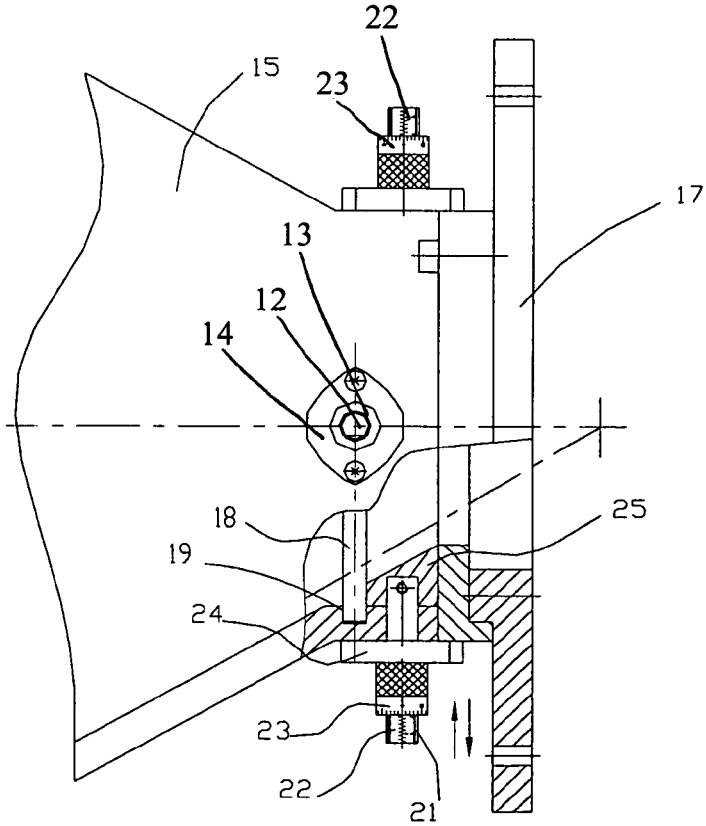
FIG. 2 shows a top view of FIG. 1.
Figure 3:
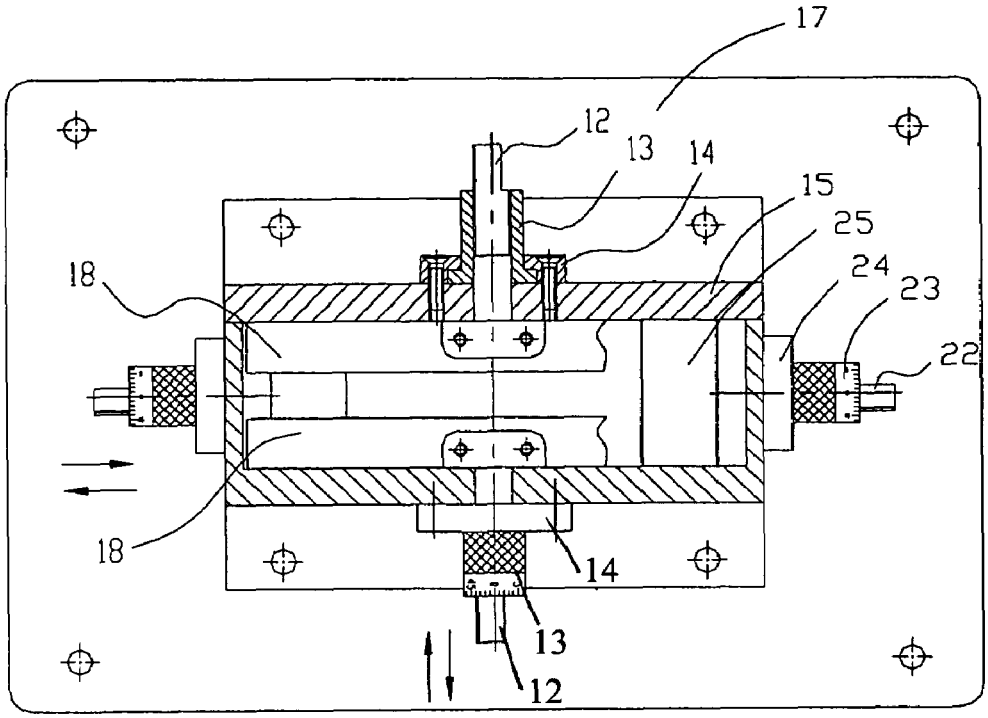
FIG. 3 shows a cross-sectional view taken along line A-A of FIG. 1.
Figure 4:
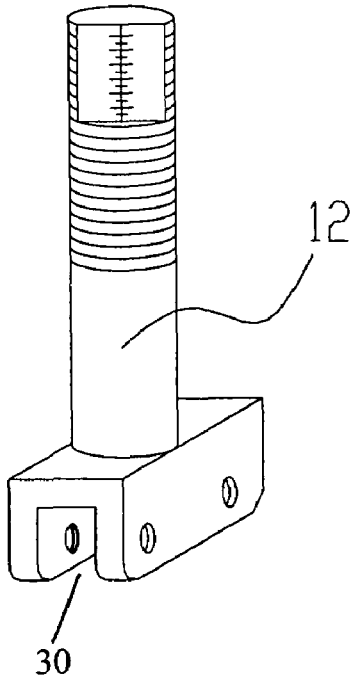
FIG. 4 shows a perspective view of a T-type leading screw of this invention.

Referring to FIGS. 1-4, the collimator according to this invention comprises an up-and-down adjustment mechanism 11, a left-and-right adjustment mechanism 21, a supporting member 15 and an adjusting plate 17 connected with the supporting member 15. Upper and lower sliding stops 18 and left and right sliding stops 25 are made of tungsten alloy or lead alloy. In the preferred embodiment, the up-and-down adjustment mechanism 11 comprises a first limiting gland cover 14, a first rotating nut 13, a leading screw threadedly connected with the first rotating nut 13, such as a T-type leading screw 12 as shown in FIG. 4, and the upper and lower sliding stops 18. The first limiting gland cover 14 is fixed to an upper wall surface and a lower wall surface of the supporting member 15, and confines the first rotating nut 13 to rotate within the first limiting gland cover 14.

A certain gap is formed between the first rotating nut 13 and the first limiting gland cover 14 so as to form a clearance fit therebetween. Clearance fit also can be formed at a position where the T-type leading screw 12 goes through the supporting member 15.

The T-type leading screw 12 is provided on ends thereof with opening grooves. The upper and lower sliding stops 18 provided in a longitudinal sliding slot 19 of the supporting member 15 are inserted into the opening grooves 30 of the T-type leading screw 12 vertically moved up and down, and are fixed by screws 31. With rotation of the first rotating nut 13, the T-type leading screw 12 is driven to longitudinally and linearly move, so that a slit formed between the upper and lower sliding stops 18 can be adjusted.

A fixed stop 16 provided behind the upper and lower sliding stops 18 is used to shield slits exposed from upper and lower ends when the upper and lower sliding stops 18 are adjusted to be closed.

The left-and-right adjustment mechanism 21 comprises a second limiting gland cover 24, a second rotating nut 23, a horizontally and left-and-right moving leading screw 22 threadedly connected with the second rotating nut 23, and left and right sliding stops 25. The second limiting gland cover 24 is fixed to a left wall surface and a right wall surface of the supporting member 15, and confines the second rotating nut 23 to rotate within the second limiting gland cover 24. The horizontally moving leading screw 22 linearly moves by the second rotating nut 23.

The horizontally moving leading screw 22 is provided in the inner ends thereof with abutting surfaces. The abutting surfaces are connected with the left and right sliding stops 25 provided in the supporting member 15. The horizontally moving leading screw 22 brings the left and right sliding stops to move along a left-to-right direction (a horizontal direction).

Furthermore, in order to observe the adjustment amount of the upper and lower sliding stops 18 and the left and right sliding stops 25, scales and numerals are marked on the first rotating nut 13 and the second rotating nut 23. Scales and numerals readable and corresponding to the first rotating nut 13 and the second rotating nut 23 are marked on the ends of the T-type leading screw 12 and the horizontally moving leading screw 22.

While the invention has been shown and described with reference to the preferred embodiment thereof, it will be understood by those skilled in the art that various changes in form and details may be made therein without departing from the spirit and scope of the invention as defined by the appended claims.

What is claimed is:

1. A collimator for adjusting an X-ray beam, comprising:

an up-and-down adjustment mechanism;

a left-and-right adjustment mechanism;

a supporting member with upper and lower wall surfaces, upper and lower sliding stops, left and right wall surfaces, and left and right sliding stops; and an adjusting plate connected with the supporting member, wherein:

the up-and-down adjustment mechanism comprises upper and lower first rotating nuts, upper and lower moving leading screws each threadedly connected with a respective one of the first rotating nuts, and first upper and lower limiting gland covers, wherein each of the moving leading screws is connected with a respective one of the upper and lower sliding stops to drive the upper and lower sliding stops, respectively, to vertically move, and the first upper and lower limiting gland covers are each fixed to a respective one of the upper and lower wall surfaces and confine the respective first rotating nuts to rotate within the respective first limiting gland covers; and the left-and-right adjustment mechanism comprises left and right second rotating nuts, and left and right horizontally moving leading screws each connected with a respective one of the second rotating nuts, wherein each of the horizontally moving leading screws is connected with a respective one of the left and right sliding stops to drive the left and right sliding stops, respectively, to horizontally move.

2. The collimator for adjusting an X-ray beam according to claim 1, characterized in that:

the left-and-right adjustment mechanism further comprises left and right second limiting gland covers that are each fixed to a respective one of the left and right wall surfaces of the supporting member and confine the respective second rotating nuts to rotate within the respective second limiting gland cover.

3. The collimator for adjusting an X-ray beam according to claim 1, characterized in that:

each of the upper and lower moving leading screws is provided at ends thereof with opening grooves, and the opening grooves are each connected with a respective one of the upper and lower sliding stops in longitudinal sliding slots provided in the supporting member.

4. The collimator for adjusting an X-ray beam according to claim 1, characterized in that:

each of the upper and lower horizontally moving leading screws is provided at ends thereof with abutting surfaces, and the abutting surfaces are each connected with a respective one of the left and right sliding stops of the left-and-right adjustment mechanism provided in the supporting member.

5. The collimator for adjusting an X-ray beam according to claim 1, characterized in that:

the first rotating nuts and second rotating nuts are marked with scales and numerals.

6. The collimator for adjusting an X-ray beam according to claim 5, characterized in that:

the upper and lower moving leading screws and the upper and lower horizontally moving leading screws are marked at ends thereof with scales and numerals corresponding to the first rotating nuts and the second rotating nuts.

7. The collimator for adjusting an X-ray beam according to claim 1, characterized in that:

a fixed stop is provided behind the upper and lower sliding stops of the supporting member.

8. The collimator for adjusting an X-ray beam according to claim 1, characterized in that:

the upper and lower sliding stops and the left and right sliding stops are made of tungsten alloy or lead alloy.

9. An adjustment device for adjusting a collimator, comprising:

an up-and-down adjustment mechanism;

a left-and-right adjustment mechanism; and a supporting member with upper and lower wall surfaces, upper and lower sliding stops, left and right wall surfaces, and left and right sliding stops; wherein:

the up-and-down adjustment mechanism comprises upper and lower first rotating nuts, upper and lower up-and-down moving leading screws each threadedly connected with a respective one of the first rotating nuts, and upper and lower first limiting gland covers, wherein each of the moving leading screws is connected with a respective one of the upper and lower sliding stops to drive the upper and lower sliding stops, respectively, to vertically move, and the upper and lower first limiting gland covers are each fixed to a respective one of the upper and lower wall surfaces and confine the respective first rotating nuts to rotate within the first limiting gland covers; and the left-and-right adjustment mechanism comprises left and right second rotating nuts, and left and right horizontally moving leading screws each connected with a respective one of the second rotating nuts, wherein each of the horizontally moving leading screws is connected with a respective one of the left and right sliding stops to drive the left and right sliding stops, respectively, to horizontally move.

10. The adjustment device for adjusting a collimator according to claim 9, characterized in that:

the left-and-right adjustment mechanism further comprises left and right second limiting gland covers that are each fixed to a respective one of the left and right wall surfaces of the supporting member and confine the respective second rotating nuts to rotate within the respective second limiting gland cover.

11. The adjustment device for adjusting a collimator according to claim 9, characterized in that:

each of the up-and-down moving leading screws is provided at ends thereof with opening grooves, and the opening grooves are each connected with a respective one of the upper and lower sliding stops provided in a longitudinal sliding slot of the supporting member.

12. The adjustment device for adjusting a collimator according to claim 9, characterized in that:

each of the horizontally moving leading screws is provided at ends thereof with abutting surfaces, and the abutting surfaces are each connected with a respective one of the left and right sliding stops provided in the supporting member.

13. The adjustment device for adjusting a collimator according to claim 9, characterized in that:

the first rotating nuts and second rotating nuts are marked with scales and numerals.

14. The adjustment device for adjusting a collimator according to claim 13, characterized in that:

each of the up-and-down moving leading screws and each of the horizontally moving leading screws are marked at ends thereof with scales and numerals corresponding to the first rotating nuts and the second rotating nuts.

15. The adjustment device for adjusting a collimator according claim 9, characterized in that:

a fixed stop is provided behind the upper and lower sliding stops of the supporting member.

16. The adjustment device for adjusting a collimator according claim 9, characterized in that:

the upper and lower sliding stops and the left and right sliding stops are made of tungsten alloy or lead alloy.

* * * * *